United States Patent [19]

Tyree

[11] 4,316,439

[45] Feb. 23, 1982

[54] ROTARY ENGINE WITH INTERNAL OR EXTERNAL PRESSURE CYCLE

[76] Inventor: Joe W. Tyree, 3201 SW. 110th, Seattle, Wash. 98146

[21] Appl. No.: 805,615

[22] Filed: Mar. 10, 1969

[51] Int. Cl.[3] ..... F02B 53/00

[52] U.S. Cl. ..... 123/246; 123/229; 123/230; 418/64; 418/167; 418/173; 418/187

[58] Field of Search ..... 123/8 PN, 60 K, 12 A, 123/8.47, 8.09, 229, 230, 246; 103/126 A, 130; 91/56, 68; 230/145; 418/64, 173, 61, 167, 187, 166

[56] References Cited

U.S. PATENT DOCUMENTS

| | | | |
|---|---|---|---|
| 2,423,507 | 7/1947 | Lawton | 418/64 X |
| 3,034,484 | 5/1962 | Stefancin | 123/12 A X |
| 3,274,945 | 9/1966 | Eickmann | 418/173 |
| 3,416,460 | 12/1968 | Eickmann | 418/167 |

FOREIGN PATENT DOCUMENTS

| | | | |
|---|---|---|---|
| 85258 | 2/1896 | Fed. Rep. of Germany | 123/12 A |
| 9359 | of 1915 | United Kingdom | 103/126 A |

*Primary Examiner*—Allan D. Herrmann

[57] ABSTRACT

Disclosed herein is a rotary engine operable as an internal combustion engine or powered from an external source, the engine comprising essentially three parts: (1) an outer housing or body, (2) a valve shaft extending axially through the body and having an eccentric mounted thereon, and (3) a rotor journalled on the eccentric. The shape of the internal surface of the housing and the rotor is such as to define a plurality of variable volume working chambers between the rotor and the housing. The rotor and internal surface of the housing may be cylindrical with the variable volume working chambers formed by sealing means projecting from the rotor in contact with the internal surface of the housing. The rotor and internal surface of the housing may also have a multi-lobed configuration with there being one less projecting lobe on the rotor than lobes in the housing with the projecting lobes of the rotor being essentially the same size and shape as those of the housing.

3 Claims, 15 Drawing Figures

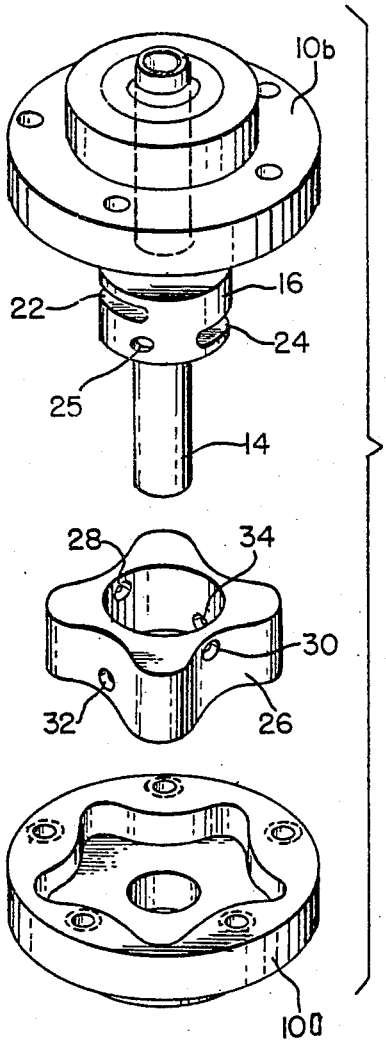
FIG—1
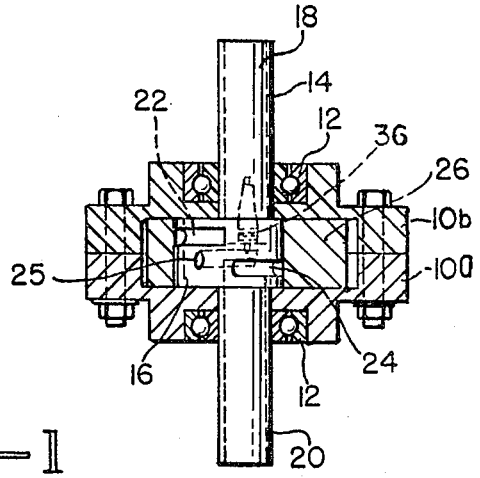
FIG—4
FIG—3
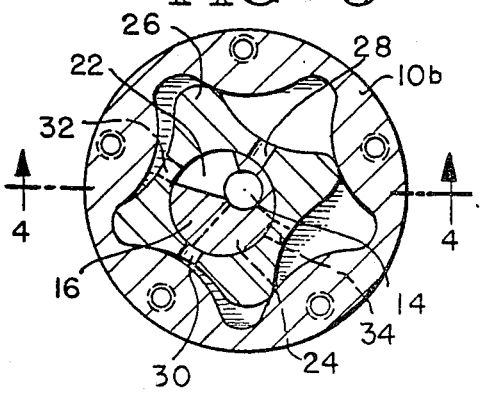
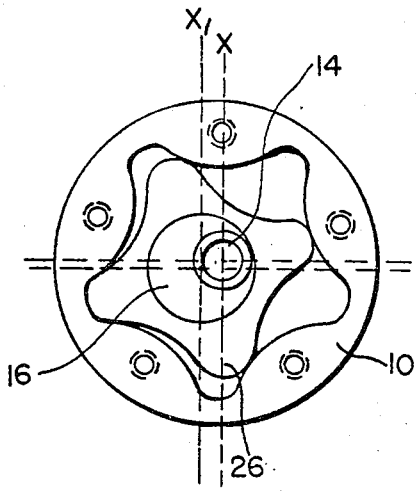
FIG—2

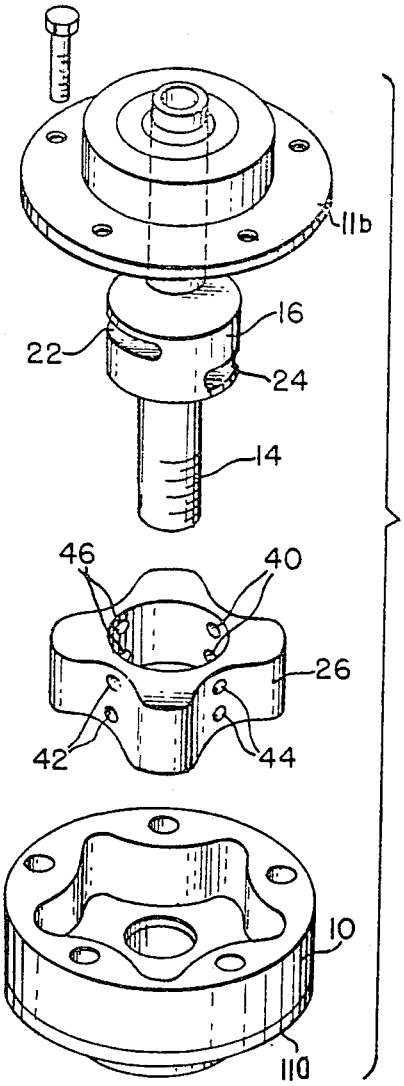
FIG-5
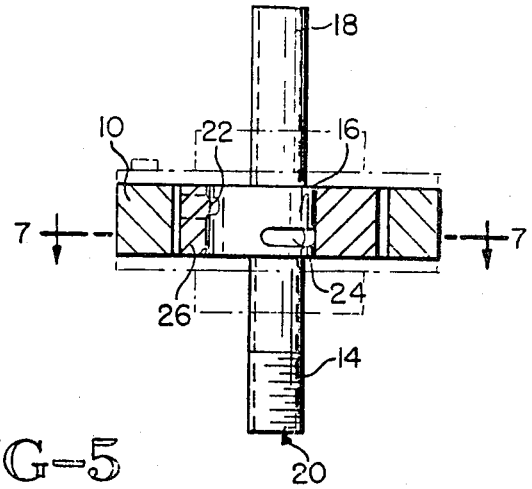
FIG-8
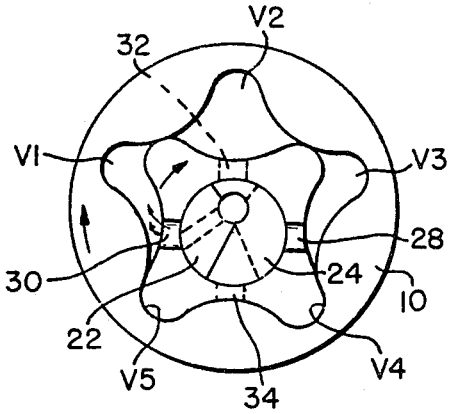
FIG-9
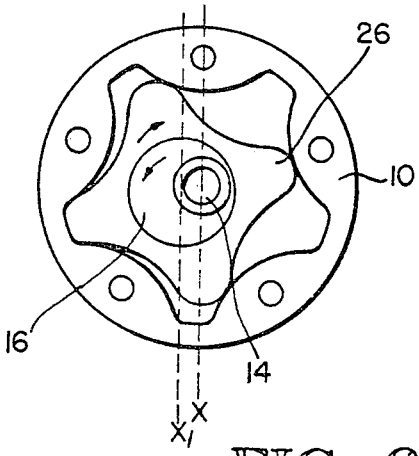
FIG-6
FIG-7
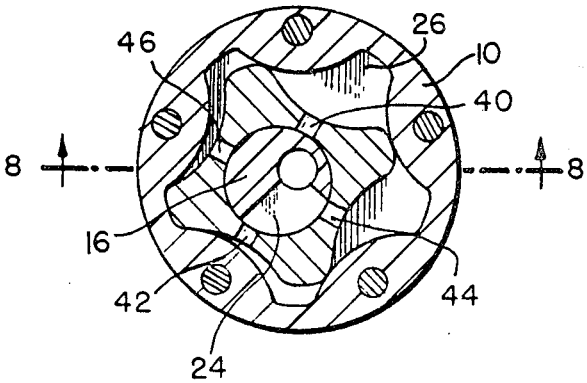

FIG-10
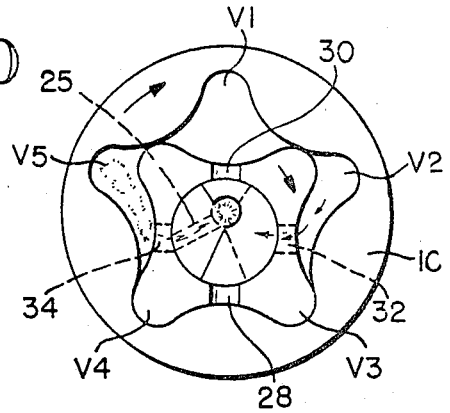
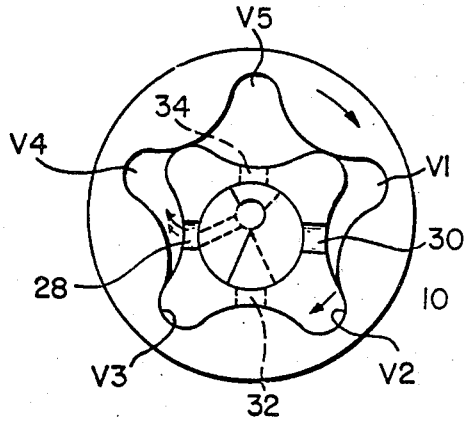
FIG-11
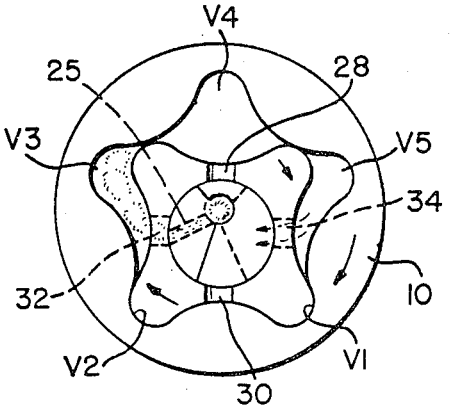
FIG-12
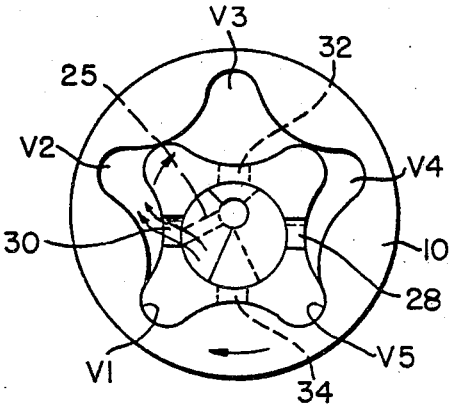
FIG-13
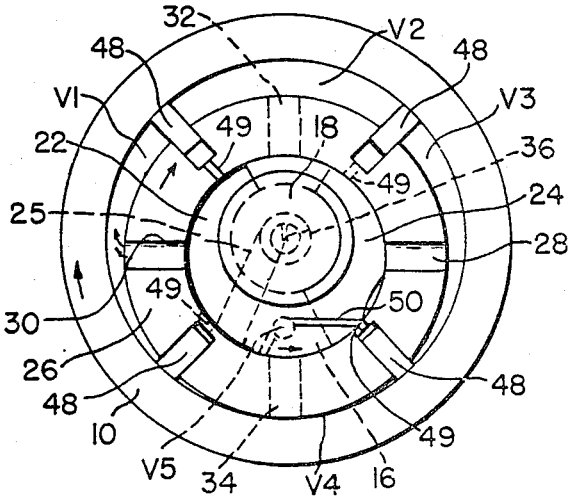
FIG-14

| | 18 & 22 IN | 20 & 24 OUT |
|---|---|---|
| 1 | A | B |
| 2 | A | CC |
| 3 | a | b |
| 4 | a | cc |

| | 20 & 24 IN | 18 & 22 OUT |
|---|---|---|
| 5 | B | A |
| 6 | CC | A |
| 7 | b | a |
| 8 | cc | a |

ROTARY ENGINE WITH INTERNAL OR EXTERNAL PRESSURE CYCLE

BACKGROUND OF THE INVENTION

1. Field of the Invention

This invention relates to a rotary mechanism having utility as a fluid pump, fluid motor, combustion engine or the like.

2. Prior Art Relating to the Invention

Rotary engines, particularly rotary combustion engines, have been developed as an alternative power supply for the commonly known reciprocating combustion engine. The most successful rotary combustion engine to date from a commercial standpoint has been the Wankel engine developed in Germany by NSU Motorenwerke, AG and in the United States by Curtiss-Wright. The Wankel engine has a three-sided triangular rotor which operates in a two-lobed epitrochoid housing with an eccentricity that depends on the engine size. There are three combustion processes per one revolution of the rotor. Because combustion and expansion occur in only one zone of the housing in the Wankel engine, that portion of the housing is subjected to hot combustion products almost continuously. This has necessitated considerable housing and rotor cooling to reduce and prevent deformation from heat stresses. This same factor has also presented a problem in maintaining sufficient lubricant for the portion of the rotor in contact with the housing. Additionally, the Wankel engine has experienced vibration problems due to the eccentric mounting of the rotor in the housing.

SUMMARY OF THE INVENTION

This invention relates to a rotary mechanism having utility as a fluid pump, a fluid motor or combustion engine. The mechanism can be used in any application where transmission of the rotary motion is desired.

The rotary mechanism of this invention has particular utility as a combustion engine. In contrast to the Wankel engine the combustion engine disclosed herein employs a plurality of combustion chambers aroud the housing, thereby subjecting the housing to hot combustion products uniformly and eliminating the need for high capacity cooling systems necessary for the Wankel engine. A further advantage of the rotary engine of this invention is its vibration free operation.

The rotary engine of this invention can be powered by internal combustion of a fuel-air mixture by an external power source such as pressurized fluid such as a liquid or gas.

In its broadest aspects the rotary mechanism of this invention comprises (1) housing means forming an internal surface means, (2) valve shaft means mounted in the housing and provided with an eccentric means, (3) a rotor journalled on the eccentric portion for rotating about its axis while the rotor axis describes a planetary motion relative to the axis of the housing, the rotor sliding along the internal surface means during movement relative thereof to the housing means and to the valve shaft means, thereby forming a plurality of working chambers between the rotor and the housing means, and (4) inlet and outlet passages communicating with each of the working chambers and disposed within the eccentric valve shaft means and rotor, with opening and closing of the inlet and outlet passages to each working chamber controlled by rotation of the rotor relative to the valve shaft means.

BRIEF DESCRIPTION OF THE DRAWINGS

FIG. 1 is an isometric view of the rotary mechanism of this invention dismantled illustrating the three essential parts of the mechanism, i.e. the housing, valve shaft means, and rotor;

FIG. 2 is a sectional view of the rotary mechanism shown in FIG. 1;

FIG. 3 is a sectional view of the rotary mechanism showing the porting in the rotor and valve shaft means;

FIG. 4 is a sectional view taken along section lines 4—4 of FIG. 3;

FIG. 5 is an expanded isometric view of a modification of the rotary mechanism of this invention for operation on compressed air or other external power source;

FIG. 6 is a sectional view of the rotary mechanism of FIG. 5;

FIG. 7 is a sectional view taken along section lines 7—7 of FIG. 8;

FIG. 8 is a sectional view taken along section line 8—8 of FIG. 7; and FIGS. 9 to 13 are views illustrating the phase relationship between the outer and inner components of the rotary engine in which the valve shaft is held stationary and the rotor and outer housing allowed to rotate;

FIG. 14 illustrates a modified form of the rotary engine in which the rotor and internal surface of the housing are cylindrical, with the working chambers defined by sealing means projecting from the rotor into contact with the internal surface of the housing.

DETAILED DESCRIPTION OF THE INVENTION

Figure 15:
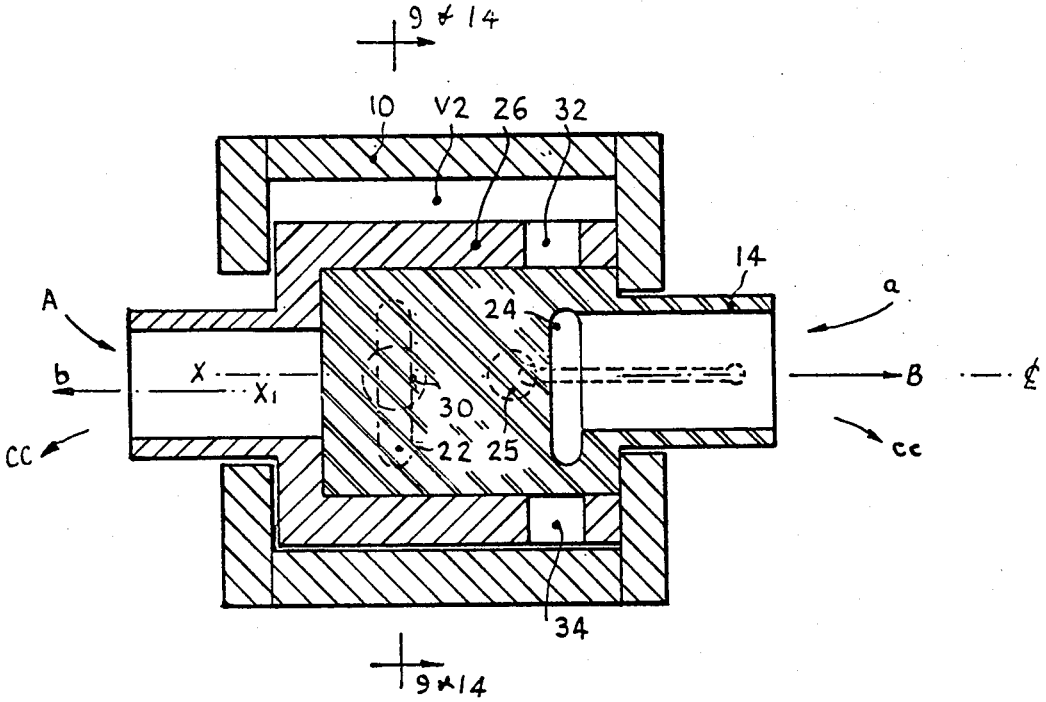
FIG. 15 is a cross-sectional view of either FIG. 9 or FIG. 14 illustrating an injection nozzle in a rotary engine where the rotor, housing and valve shaft may be allowed to rotate if desired.

The rotary mechanism of this invention can be powered by an external source such as compressed air, steam, etc. or it can be constructed as an internal combustion engine. The mechanism has few moving parts and is capable of operating at high efficiency. The essential components of the mechanism inlude (1) an outer housing, (2) a valve shaft provided with an eccentric means mounted in the outer component axially of the inner vertical wall of the outer component and (3) an inner component or rotor journalled on the eccentric portion. Both the inner and outer components are rotatable in the same direction although at different speeds. The ratio of speed of the outer component to the inner component is dependent upon the number of lobes on the inner component in relation to the number on the outer component or on the ratio of rolling girth of the inner housing surface to the rolling girth of the rotor. The speed ratio of the outer component to the inner component is equal to $N+1/_N$ where N is the number of lobes in the outer component.

It is preferred that the valve shaft be held stationary and both the inner and outer components allowed to rotate, although the outer component can be held stationary and the inner component and valve shaft allowed to rotate. Operation of the rotary mechanism of this invention is substantially vibration free when the inner and outer components are allowed to rotate and the valve shaft held stationary. This is a decided advantage over many of the prior rotary engines in which vibration has been a problem.

Multi-Lobed Engine

The outer component or housing of the rotary engine shown in FIGS. 1–13 has five lobes while the inner component or rotor has only four. The number of projecting lobes on the inner component or rotor must always be one less than the number of lobes in the outer component. The number of lobes in the outer component, however, may be more or less than that shown.

When the rotary engine described is operated as an internal combustion engine the working cycle of the engine comprises (1) fuel intake (2) compression, (3) expansion and (4) exhaust. Addition of more lobes to the outer component gives more cylinders under power impulse. The engine shown is capable of delivering 2.5 power impulses per revolution of the inner component. There are 10 working cycles per revolution with one working cycle taking place every 36° of revolution of the inner component.

Referring to FIG. 1 the outer component or housing 10 may consist of two halves 10*a* and 10*b* as shown in FIG. 1 or comprise a peripheral shell 10 and axially spaced end walls 11*a* and 11*b* as shown in FIG. 5. The inner peripheral surface of the housing has a multi-lobed configuration and resembles a modified hypocyloid. Central openings are provided in end walls 11*a* and 11*b* or component halves 10*a* and 10*b* for receiving suitable bearings such as ball bearings 12 (see FIG. 4) for supporting shaft 14.

Shaft 14 is coaxial with axis X (see FIGS. 2 and 6) of the inner surface of the outer housing 10. The portion of the shaft extending between the end walls of the outer housing has an eccentric 16 mounted thereon and a rotor 26 or inner component journalled on the eccentric. Shaft 14 has passages 18 and 20 which lead from opposite sides or the same side to the interior portion of the shaft on which the eccentric and rotor are mounted. These passages are not interconnected. Passages 18 and 20 connect with openings 22 and 24 which extend to the outer peripheral surface of the eccentric. One passage operates as the intake port and the other exhaust port. The intake port can be used as the exhaust port and vice versa. The only thing changed by reversal of the ports is reversal of the direction in which the engine rotates.

On shaft 14 is journalled rotor 26 which has a peripheral outer contour corresponding approximately to the inner hypocycloidal curve of the outer component or housing 10. The outer surface of rotor 26 will always have a contour somewhat less than that of the inner contour of the outer components of housing 10. The axis X1, of the rotor, on rotation thereof, describes a planetary motion relative to the axis X of the housing 10 and shaft 14. Rotor 26 has ports cut therein at the inner radial portions thereof which communicate with openings 22 and 24 in eccentric 16. When the engine is operated as an internal combustion engine (see FIG. 1) ports 28 and 30 are cut opposite each other and communicate with opening 22 on rotation of rotor 26 while ports 32 and 34 communicate with opening 24 on rotation of the rotor. When operating an external power (see FIG. 5) ports 40, 42, 44 and 46 are cut in the rotor as shown in FIG. 5 and communicate with channels 22 and 24.

Variable volume working chambers (see FIGS. 9 to 13) V1, V2, V3, V4 and V5 are defined between the inner contour of component 10 and the outer contour of rotor 26 on relative rotation of one or both components.

It is preferable, when the engine is operated as an internal combustion engine, to locate the spark plug 36 or other ignition means in the valve shaft means with the electrodes of the spark plug communicating with the variable volume chambers formed by the end walls and inner peripheral wall of the outer component 10 and the outer peripheral wall of rotor 26 by means of a passage 25 cut in the valve shaft and eccentric. A fuel injection nozzle can also be inserted in the valve shaft means in place of the spark plug if desired as illustrated by FIG. 15. FIG. 15 also includes a table having the labels "IN" and "OUT" which indicate the several modes of transfer of a power charge through the engine. For example a unit charge in at A may exit at B or C.

In operation rotor 20 performs a planetary rotary movement with respect to the outer component 10. As rotor 26 follows its eccentric path of revolution within the outer component 10 the chambers V1, V2, V3, V4 and V5 vary in volume. During revolution of the rotor the intake and exhaust parts are opened and closed in proper sequence. During each complete revolution of rotor 26 each chamber undergoes the four phases of the engine cycle: intake, compression, expansion and exhaust.

The rotary mechanism of this invention can be driven equally well from an external power source such as compressed air, steam, fluid (hydraulic) or gases formed in an external combustion chamber by simple modification of the porting in rotor 26. As shown in FIG. 5, rotor 26 is provided with pairs of ports 40, 42, 44 and 46 which communicate with passages 22 and 24 in the eccentric. Obviously passage 25 and ignition means 36 are not used when the engine is operated on external power and may be eliminated. Operating on external power there are two chambers under power impulse at all times. Using steam as an external power source, for example, steam is injected in passage 18, port 22 and ports 42 or rotor 26 into a working chamber and is exhausted through ports 44, passage 24 and passage 20.

Sealing means such as ring grooves, spring-loaded sealing members mounted in slots, etc. may be used to isolate the working chambers from each other. Seals may be located on the edges of each apex portion of rotor 26, around the outer periphery of the eccentric at the edges thereof, and in the inner peripheral portion of rotor 26 between each of the ports.

In FIGS. 9 to 13 is illustrated the working cycle during one revolution of the outer component or housing 10 when the engine is operated as an internal combustion engine. Between each two successive figures there is a displacement angle of 72° in the clockwise direction of the center of the outer component housing 10. The complete working cycle for one revolution of the outer housing will be described. In FIG. 9 the rotor is in a position so that port 30 is opened to opening 22 and passage 18 producing intake at V1. Ports 28, 32 and 34 are closed. As housing 10 and rotor 26 rotate clockwise to the position shown in FIG. 10 port 34 is opened to passage 25 allowing the fuel-air mixture in chamber V5 to be exposed to the electrodes of spark plug 36 and be ignited. At the same time port 32 is opened to opening 24 and the previously ignited combustion gases in chamber V2 exhausted therethrough.

In FIG. 11 port 28 is opened to opening 22 and passage 18, admitting an air-fuel mixture to chamber V4. At the same time the air-fuel mixture in chamber V1 is being compressed while the air-fuel mixture in chamber V3 is fully compressed.

In FIG. 12 port 32 is opened to passage 25 allowing the air-fuel mixture in chamber V3 to ignite. At the same time port 34 is opened to opening 24 and passage 20 allowing the combustion gases in chamber V5 to be exhausted therethrough.

In FIG. 13 the air-fuel mixture in chamber V1 is fully compressed. Port 30 is opened to channel 22 and passage 18 for admitting an air-fuel mixture to chamber V2. Ignition of the air-fuel mixture in V1 occurs next in the cycle although it is not shown in the drawings. Firing order starting with the air-fuel charge in V1 is V1-V4-V2-V5-V3.

CYLINDRICAL ENGINE

FIG. 14 shows a modification of the rotary engine in which the internal surface of housing 10 and the outer peripheral surface of rotor 26 are cylindrical. The variable volume working chambers V1, V2, V3, V4 and V5 are defined by a series of projecting sealing members 48 fitted into regularly spaced recesses or slots in rotor 26. The sealing members 48 are maintained in sealing relation with the internal surface of housing 10 during rotation by springs, hydraulic pressure or pressure from the combustion gases on ignition. In the latter instance a small cavity 49 is drilled in the bottom of each of the slots beneath the sealing members 48, the cavity communicating with the working chamber during combustion. The working cycle of the engine shown in FIG. 14 is the same as that described in regard to FIGS. 9 to 13. A pre-combustion chamber 50 is routed in valve shaft 16 as shown in FIG. 14.

The engines described above go through 40 cycles before a repetition of events occurs, i.e. there are ten intake, compression, expansion and exhaust cycles.

The rotary engine of the present invention has many applications. It may be used, for example, to power vehicles, blowers, propellers, armatures, etc. The shape of the outer housing can determine the usefulness of the engine. For example, the outer housing can be in the shape of a vehicle wheel, propeller, etc.

Operated from an external power source, the engine can be run under water. It can be used in any application where rotary motion is needed. As explained previously, it is preferable that the valve shaft be held stationary and the outer housing and rotor allowed to rotate. Operation of the engine in this manner substantially eliminates any vibration. The engine can be operated substantially vibration free with the housing 10 held stationary and the valve shaft 16 and rotor 26 allowed to rotate provided the valve shaft 16 is balanced. Friction is substantially reduced in the engine of this invention as the rotor and outer housing are in substantial rolling and not sliding contact with each other.

A prototype engine having the configuration shown in the drawings was operated on compresssed air and steam. The engine was $1\frac{3}{4}''$ in outside diameter, $\frac{7}{8}''$ in thickness, and $\frac{1}{8}''$ diameter ports, and a cylinder displacement of less than $\frac{1}{2}''$. Using 60 psi compressed air the engine turned at a speed of approximately 10,000 rpm. After many hours of operation no signs of wear were apparent.

Although the rotary engine of this invention has been described with particular reference to the drawings it is to be understood that these are exemplary only. For example, the engine can be operated as a diesel engine using a suitable fuel injector nozzle in place of the ignition means.

The embodiments of the invention is which an exclusive property or privilege is claimed are defined as follows:

1. A rotary mechanism for fluid pumps, fluid motors, combustion engines or the like comprising:

housing means forming an internal surface means, valve shaft means mounted in the housing and provided with an eccentric means, a rotor journalled on the eccentric portion for rotation about its axis while the rotor axis describes a planetary motion relative to the axis of the housing, the rotor having projecting sealing means disposed intermittently around the outer periphery of the rotor in sealing engagement with the internal surface means of the housing thereby forming a plurality of variable volume working chambers between the rotor and housing means, and inlet and outlet passages communicating with each of the working chambers disposed within the eccentric valve shaft and rotor with opening and closing of the inlet and outlet passages to each working chamber controlled by rotation of the rotor relative to the eccentric valve shaft means, the internal surface means of the housing means has a plurality of symmetrically arranged circumferentially spaced concave lobe portions and the rotor has a plurality of symmetrically arranged circumferentially spaced convex lobe portions on the peripheral outer surface, there being one less lobe on the rotor than the housing means, the lobes of the rotors substantially filling the lobes of the housing as the rotor rotates in the housing, an air-fuel mixture is received at predetermined intervals into the working chambers, compressed, expanded and released in a normal work cycle.

2. A rotary mechanism for fluid pumps, fluid motors, combustion engines or the like comprising:

housing means forming an internal surface means, valve shaft means mounted in the housing and provided with an eccentric means, a rotor journalled on the eccentric portion for rotation about its axis while the rotor axis describes a planetary motion relative to the axis of the housing, the rotor having projection sealing means disposed intermittently around the outer periphery of the rotor in sealing engagement with the internal surface means of the housing thereby forming a plurality of variable volume working chambers between the rotor and housing means, and inlet and outlet passages communicating with each of the working chambers disposed within the eccentric valve shaft and rotor with opening and closing of the inlet and outlet passages to each working chamber controlled by rotation of the rotor relative to the eccentric valve shaft means, ignition means communicating with the working chambers at sequenced intervals for combusting a fuel-air mixture, the firing order of the working chambers fires every other chamber beginning with the first fired chamber.

3. A rotary internal combustion engine comprising:

housing means having an inner peripheral wall, a valve shaft extending into the housing axially of the inner peripheral wall thereof having an eccentric mounted thereon, a rotor journalled on the eccentric for rotation about its axis while the rotor axis describes a planetary motion relative to the axis of the housing means and valve shaft, an even number of projecting sealing means disposed at regularly spaced intervals around the outer periphery of the rotor in sealing engagement with the inner peripheral wall to form a plurality of variable volume working chambers between the rotor and the inner peripheral wall of the housing means, separate laterally offset inlet and exhaust passages in the eccentric for conducting a fuel-air mixture and exhaust mixture respectively, inlet ports disposed in the rotor between every other of the sealing means connecting the inlet passage in the eccentric with a working chamber at sequenced intervals on rotation of the rotor relative to the eccentric, exhaust ports disposed in the rotor between each of the sealing means not having an inlet port, the exhaust ports connecting the exhaust passage in the eccentric with a working chamber at predetermined intervals on rotation of the rotor relative to the eccentric, the inlet and exhaust ports allowing intake, compression, expansion and exhaust of a fuel-air mixture in a normal work cycle, and ignition means communicating with the working chambers at sequenced intervals for combusting the fuel-air mixture.

* * * * *

UNITED STATES PATENT AND TRADEMARK OFFICE

CERTIFICATE OF CORRECTION

PATENT NO. : 4,316,439

DATED : February 23, 1982

INVENTOR(S) : Joe W. Tyree

It is certified that error appears in the above-identified patent and that said Letters Patent is hereby corrected as shown below:

IN THE DRAWINGS

Sheet 2 of 4 "FIG-7" correct: "26" to read --V2-- and --DRAWINGS-- "FIG-6" add section line: --15-- see ref. (For correct ref. to above:

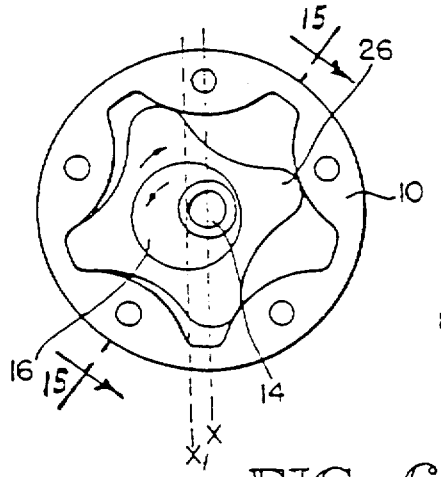

FIG-6

FIG-7

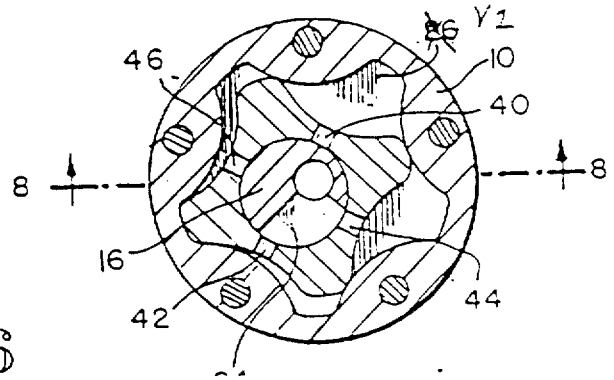

UNITED STATES PATENT AND TRADEMARK OFFICE

CERTIFICATE OF CORRECTION

PATENT NO. : 4,316,439

DATED : February 23, 1982

INVENTOR(S) : Joe W. Tyree

It is certified that error appears in the above-identified patent and that said Letters Patent is hereby corrected as shown below:

Claim "1" line 30 after "housing" correct:
"an air-fuel mixture" to read --working means--
"in lines 31-32 remove: --compressed expanded--
Column "4" line 13 after "operation" correct:
"rotor 20" to read --rotor 26--

Column "4" lines 63-64-65-68 after "an" "the" correct:
"air-fuel mixture" to read --fuel-air mixture--

Column "5" lines 4-6-7-9 after "the" correct:
"air-fuel mixture" to read --fuel-air mixture--

Signed and Sealed this

Fourteenth Day of August, 1990

*Attest:*

HARRY F. MANBECK, JR.

*Attesting Officer*

*Commissioner of Patents and Trademarks*